United States Patent [19]

Beaudry

[11] Patent Number: 4,891,031

[45] Date of Patent: Jan. 2, 1990

[54] SPINNING TOP AND DRIVING DEVICE FOR ACTUATING THE SAME

[76] Inventor: Normand A. Beaudry, 2082, Chapdelaine St., Ste-Foy, Quebec, Canada, G1V 1M3

[21] Appl. No.: 167,951

[22] Filed: Mar. 14, 1988

[51] Int. Cl.[4] ..... A63H 1/00

[52] U.S. Cl. ..... 446/259; 446/256; 446/262; 446/264

[58] Field of Search ..... 446/233, 235, 256, 257, 446/258, 259, 261, 262, 263, 264

[56] References Cited

U.S. PATENT DOCUMENTS

| | | | |
|---|---|---|---|
| 188,095 | 3/1877 | Beesley | 446/233 |
| 484,960 | 10/1892 | Hardy | 446/233 |
| 635,020 | 10/1899 | Kornick | 446/263 |
| 673,831 | 5/1901 | Cook | 446/263 |
| 719,276 | 1/1903 | Thornburg | 446/264 |
| 1,922,990 | 8/1933 | Thompson | 446/263 X |
| 2,039,819 | 5/1936 | Marx | 446/233 X |
| 2,762,162 | 9/1956 | Doljan | 446/233 |
| 2,794,294 | 6/1957 | Frangos | 446/235 |
| 3,365,835 | 1/1968 | Grow | 446/233 |

FOREIGN PATENT DOCUMENTS

| | | | |
|---|---|---|---|
| 1016115 | 11/1952 | France | 446/263 |

*Primary Examiner*—Robert A. Hafer
*Assistant Examiner*—Sam Rimell
*Attorney, Agent, or Firm*—Roland L. Morneau

[57] ABSTRACT

A driving device for initiating and maintaining a spinning top in a continuous movement of rotation and precession. The driving device is made of a shaft adapted to axially rotate in a tube on which is concentrically fixed a rim. A top is hingely connected by its central post to the end of the shaft adjacent the rim. The post is able to rotate around the rim through a ball-bearing joint and the friction between the post and the rim causes the top to spin around the rim. By momentarily braking or changing the direction of the shaft with a manual contact on the shaft, it is possible to create a precession movement to the spinning top which will raise above the rim.

13 Claims, 3 Drawing Sheets

Fig.18
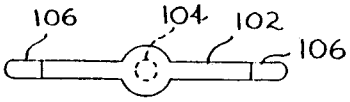
Fig.17
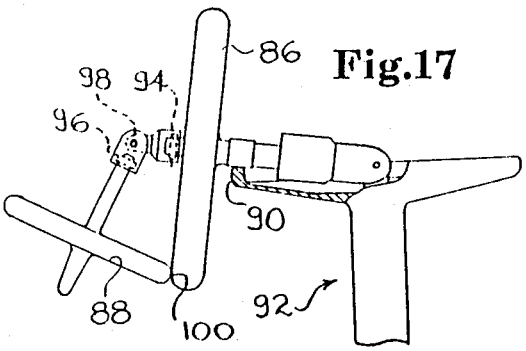
Fig.14
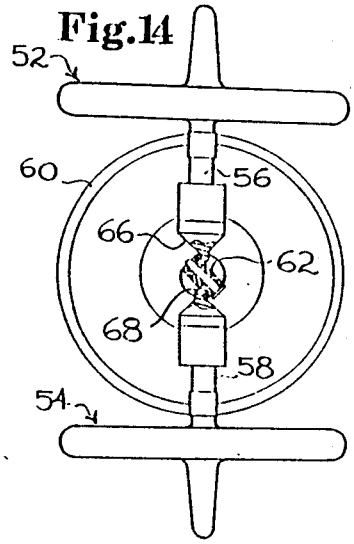
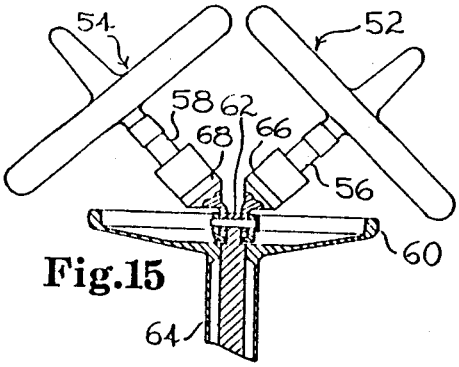
Fig.15
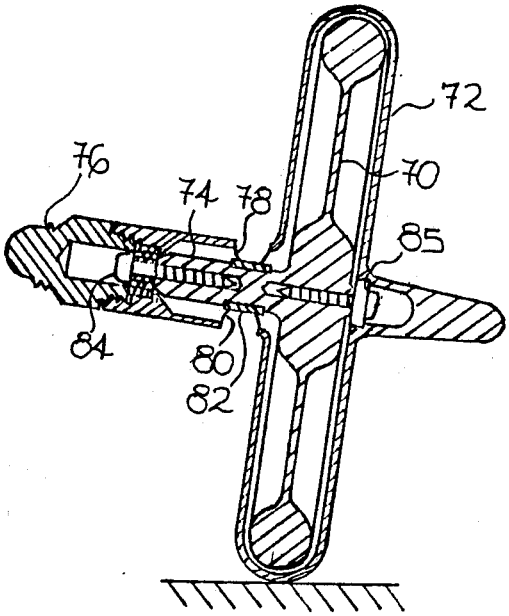
Fig.16

SPINNING TOP AND DRIVING DEVICE FOR ACTUATING THE SAME

BACKGROUND OF THE INVENTION

1. Field of the Invention

The present invention relates to a driving device for a spinning top which can initiate and maintain a continuous movement of rotation and precession of the top. The device also allows the operator of the device, using only one hand to modify and control the precession movement of the top while spinning. The spinning top and the driving device may be used as a toy or as an apparatus for demonstrating precession and nutation movements.

2. Prior Art

A search of the prior art has failed to reveal any mechanism which can be patentably compared with the present device. In U.S. Pat. No. 3,365,835, a motor is used to spin a top by rotating the tip end of the central post. U.S. Pat. No. 2,762,162 uses a frictional roller to spin the top but no precise mechanism is specified to actuate that roller.

SUMMARY OF THE INVENTION

The device for initiating and maintaining a continuous movement of rotation and precession to a spinning top comprises a tubular member, a shaft rotatably mounted inside the tubular member and longitudinally fixed therewith. A riding rim concentrically located relative to the tubular member is secured to the latter at one end thereof. A pivoting member is hingely fixed to the shaft about the level of the rim and adapted to pivot about a transversal axis relative to said shaft. The pivoting member is adapted to be connected to one end of the central post of a spinning top, by a sleeve rotatable about the axis of the post. The post, while in its horizontal position, can rotatably ride on the rim by causing the spinning wheel of the top to rotate around the rim and around its own axis. The shaft is partly exposed outside the tubular member for manual contact for allowing an operator to momentarily brake or change the rotation of the shaft and causing the post to lift from the rim and to provide a precession movement to the spinning top. The change of rotation can be produced by a short reversal of the initial rotation of the shaft.

BRIEF DESCRIPTION OF THE DRAWINGS

FIG. 14 is a top view of a different embodiment of the invention, FIG. 15 is a side view partly in cross-section of the embodiment shown in FIG. 14 with the spinning tops in a precession movement, FIG. 16 is a cross-sectional view of another embodiment of a spinning top according to the invention, and FIG. 17 is a side view of two superposed spinning tops mounted on a driving device partly shown in cross-section.

FIG. 18 is a top view of a spinning wheel according to a different embodiment of the invention.

DETAILED DESCRIPTION OF THE INVENTION

Figure 1:
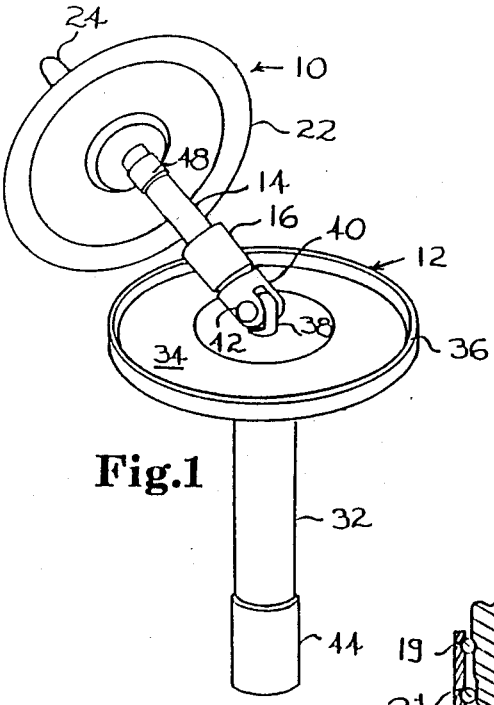
FIG. 1 is a perspective view of a spinning top mounted on a driving device for actuating the spinning top, according to the invention.
Figure 2:
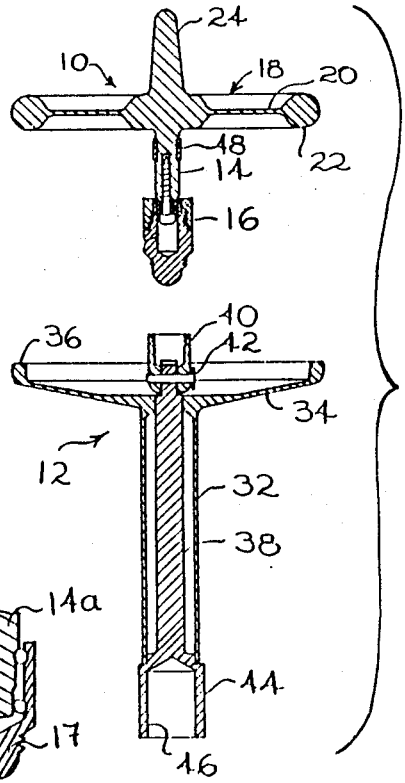
FIG. 2 is a cross-sectional view of the spinning top separated from the driving device.

FIG. 1 illustrates in combination the spinning top 10 and the driving device 12 which is intended to initiate, actuate and maintain a continuous movement of rotation and precession of the spinning top 10, FIG. 2 illustrates a cross-sectional view of the spinning top 10 and the driving device 12.

The spinning top 10 includes a central post 14, a rotatable sleeve 16 axially mounted on the post 14 with a screw 15. A flywheel 18 is made of a disc portion 20 and a concentric beaded portion 22. A tip portion 24 is an extention of the post 14 on the other side of the disc 20. Although, the spinning wheel illustrated in figs. 1 and 2 is made of a disc 20 and bead 22 having an evenly distributed weight, the disc could be replaced by individual spokes and the bead could be made of discontinuous and balanced weights around the axis of the post 14. One embodiment of the rotatable sleeve 16 is illustrated in FIG. 3. It is made out of a ring 26 mounted on ball-bearings 28 around the tip of the post 14. The ring 26 is mounted on the post 14 preferably in a permanent manner and is adapted to threadedly engage a linking member 30 adapted to threadedly engage a portion of the driving device 12. It should be obvious that the sleeve 16 can be rotatably mounted on the post 14 by means of needle bearings or equivalent means having a low friction in rotation.

Figure 3A:
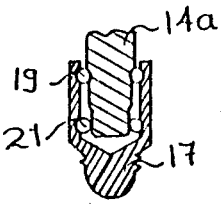
FIGS. 3 and 3*a* are a cross-sectional views of rotatable sleeves mounted at the end of the spinning top, FIGS. 4 to 13 inclusive illustrates possible operations of the spinning top and the driving device according to the invention.
Figure 3:
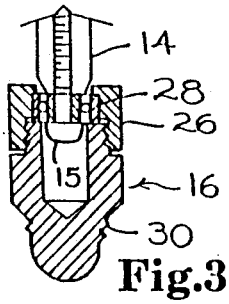

FIG. 3*a* illustrates an alternative embodiment of the rotatable sleeve shown in FIG. 3. The tip 14*a* of the post 14 is surrounded by a sleeve 17 which is rotatable around the tip 14*a* on a pair of adjacent ball-bearing rings 19 and 21. The ring of ball-bearings 19 rotates in circular carved recesses in both the tip 14*a* and in the sleeve 17. The recesses for the ring 19 are deep enough to axially support the post 14 particularly when the top is dropped on the floor. The ring 21 rotates in a carved recess located only in the sleeve 17. The lower end of the tip 14*a* has a reduced diameter to prevent the need for maintaining a high degree of tolerance and to facilitate the penetration of the tip 14*a* through the ring 21. The double pair of ball-bearing rings 19 and 21 helps to keep a better alignment of the post 14 in the sleeve 17 and increases the spinning time of the top 10. Nylon is a suitable material for the sleeve 17 and the tip 14*a*.

The driving device 12 is made of a tubular member 32 ending at one end by a concentric dish-like member 34 surrounded by a driving rim 36. A shaft 38 is axially mounted in the tubular member 32 and is abutted at both ends to prevent axial movement and to allow a concentric rotation of the shaft 38 inside the tubular member 32. The shaft 38 projects outside the tubular member 32 inside the driving rim 36 for hingingly connecting socket 40 by means of a rivet 42. The socket 40 is internally threaded to receive the correspondingly threaded linking member 30. The lower end of the shaft 38 extends outside the tubular member 32 and is exposed to allow manual contact with the protuberant member 44. The protuberance member 44 forms an internal socket 46 for the purpose explained latter.

When the spinning top 10 is threadedly mounted on the driving device 12 the post 14 abuts on the riding rim 36. In order to increase the friction between the post 14 and the riding rim 36, in a substantially horizontal plane a rubber band 48 encircles the post 14 at a distance from the shaft corresponding to the riding rim 36. The rubber band 48 may be made of a plurality of resilient material such as polyvinylchoride.

Figure 4:
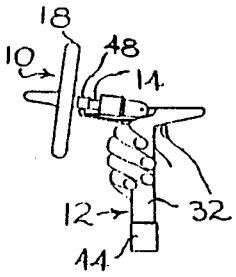
Figure 5:
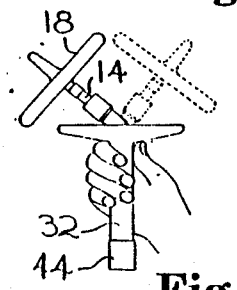
Figure 6:
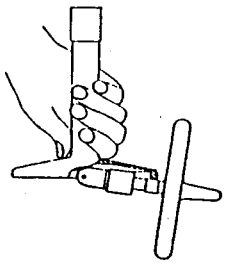
Figure 7:
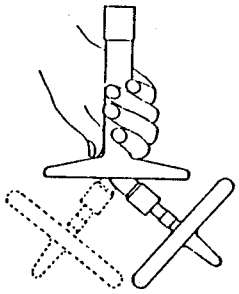
Figure 8:
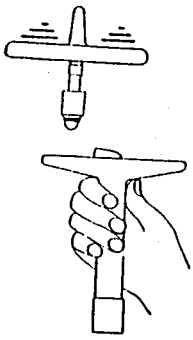
Figure 9:
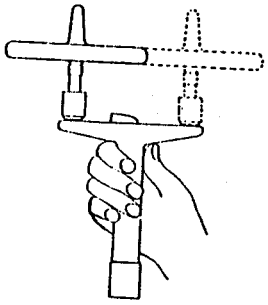
Figure 10:
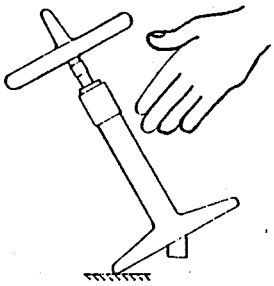
Figure 11A:
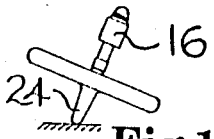
Figure 11B:
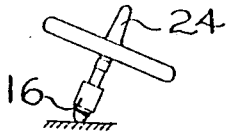

The spinning operation is initiated as illustrated in FIG. 4. The tubular member 32 is held with one hand and is made to oscillate in small circles in order to create a centrifugal force to the spinning top 10 around the riding rim 36. Care must be taken not to touch the protuberance portion 44 during this initial operation. The weight of the spinning top 10 keeps the rubber band 48 in contact with the driving rim 36 and the friction therebetween causes a rotation of the spinning wheel 18 and the post 14. The faster the spinning top 10 rotates around the axis of the shaft 38, the faster the spinning wheel 18 rotates about the axis of the post 14.The rotation of the spinning top 10 around the axis of the shaft 38 causes a rotation of the protuberance member 44. When the rotation of the spinning top 10 around the axis of the shaft 38 and around the axis of the post 14 has reached a minimum speed, it is possible to create a precession movement to the spinning top 10, as shown in FIG. 5, by momentarily braking or changing the rotation of the protuberance member 44. The reduction of the speed of the protuberance member 44 relative to the speed of the spinning wheel 18 will create a lifting effect on the spinning top, that is, the post 14 will adapt an angular position relative to its original one and a precession movement of the spinning top will take place as shown in FIG. 5. The same results are obtained even when the driving device is upside down as shown in FIGS. 6 and 7.

Figure 13:
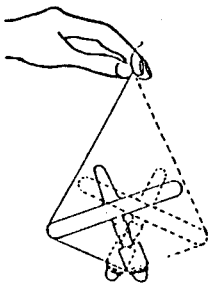
Figure 12:
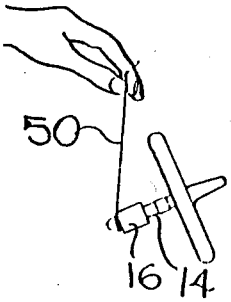

With sufficient skill and when the spinning top has a sufficient high speed, it becomes possible to remove the top 10 from the driving device 12 and to use them in a combination of arrangements such as illustrated in FIGS. 8 to 13 inclusive. This operation is accomplished while the top is spinning by holding the sleeve member 16 with one hand and by unscrewing it from the pivoting member 40 by rotating the protuberance member 44 with the other hand. It is obvious that the top can be held, while rotating, by the sleeve member 16 on account of the ball-bearing arrangement of the rotatable sleeves shown in FIGS. 3 and 3*a*. Once the spinning top has been unscrewed from the driving device, it is possible to put it in one of the positions illustrated in FIGS. 8 to 13. The spinning top can spin while resting on its tip 24 or on its rotatable sleeve 16. The fact that the spinning top 10 has a rotatable sleeve 16 at one end of the post 14 makes it possible to suspend the top 10 in motion by a string 50 as illustrated in FIGS. 12 and 13. It should be noticed that the open recess 46 in the protuberant member 44 fittingly corresponds to the diameter of the sleeve 16 to operate as in fig. 10.

A large plurality of other combinations of movements may be contemplated and is frequently limited only by the skill of the operator. FIGS. 14 and 15 illustrate an embodiment of the invention in which two spinning tops are connected to the shaft 64, the spinning tops being oriented in opposite directions. In FIG. 14, the posts 56 and 58 are illustrated in an alternative position during rotation. The posts 56 and 58 are respectively connected to the upper tip 62 of the shaft 64 by linking members 66 and 68 bent relative to the shaft 62 so as to maintain the spinning wheels 52 and 54 spaced apart from each other. Once the two spinning tops 52 and 54 have achieved a certain rotating speed around the rim 60, it is possible by acting on the shaft 64, such as explained above, to raise the two posts 56 and 58 away from the rim 60. A precession movement is accordingly created while the two tops are spinning around their axis. The linking members 66 and 68 are also bent as shown in FIG. 15 so as to prevent the two spinning tops from touching each other while in their raised positions. It should be obvious that a third spinning top could be mounted between tops 52 and 54 and connected to the shaft 64 as long as the link of the central post of this additional top is longer than the posts of the tops 52 and 54 and forms an extention of the shaft 64 so that their movements do not interfere with one another.

Another embodiment for the spinning top is illustrated in FIG. 16 which consists in enclosing the top 70 with a casing 72. The casing 72 extends around the post 74 to form the linking member 76. The spinning top 70 can spin inside the casing 72 without any substantial movement of the latter. In order for the rim 60 of the driving device to frictionnally engage the post 74, two apertures are provided in the casing in a location corresponding to the rubber band 82 which corresponds to the rubber band 48 identified in FIGS. 1 and 2. When the linking member 76 is threadedly mounted in the threaded socket 40, in the manner illustrated in FIG. 2, the rubber band 82 rest on the rim 36 which allows the rotation of the top 70 inside the casing 72. Such rotation is possible due to the ball-bearing joints 84 and 85 supporting the top 70 inside the casing 72. With such spinning top, it is possible to stabilize the casing 72 on it side as shown in FIG. 16 while the spinning top 70 rotate inside the casing.

Another embodiment is illustrated in FIG. 17 wherein two spinning tops 86 and 88 are superposed one at the end of the other. The spinning top 88 is substantially similar to the one described in FIGS. 1 and 2 and the top 88 is connected by two ball-bearings arrangement 94 and 96 linked to each other by a hinge 98. The outer diameter of the spinning wheel of both tops 86 and 88 are designed so that they frictionnally contact about their periphery as identified by the point 100. The rotation of the spinning top 86 is initiated as explained in FIGS. 1 and 2 and the rotation of its flying wheel causes the rotation of the flying wheel of the top 88 and the precession movement of the top 86 is produced in the same manner as explained in FIGS. 1 and 2.

Flywheels illustrated above consisted essentially of a disc 20 surrounded by a circular bead 22 as illustrated in FIGS. 1 and 2 but it is also within the embodiment of this invention to use, as shown in FIG. 18, a rod 102 connected at its center 104 to the shaft of a driving device and supporting two identical weights 106 at both ends of the rod 102.

As a toy, the present invention has a simple construction. Its light weight prevents the user from injuring himself when the mechanism is in movement.

Another particular advantage of the present invention is that the spinning top can be actuated by a light movement of the hand and the user does not have to wait until the spinning top has stopped to return the top to its desired speed. In fact, it is possible to alternately provide the top with a precession movement due to gravity to a fast precession movement due to a moment of force provided by the driving mechanism.

The spinning top used with its driving device does not require an additional surface, such as a floor or a table to operate and accordingly does not scratch such surfaces.

I claim:

1. A driving control device adapted to actuate a spinning top which is provided with an axial post, a flywheel concentrically secured to said post, and with a rotatable sleeve member axially mounted at one end of said post, said device comprising a tubular member having a central longitudinal axis, a riding rim secured to said tubular member at one end thereof, said rim being concentrically located relative to said longitudinal axis, a shaft rotatably mounted inside said tubular member, said shaft being longitudinally fixed relative to said tubular member, part of said shaft being exposed through said tubular member for allowing manual contact with said shaft, a pivoting member hingely secured at one end of said shaft adjacent said rim and adapted to pivot about a transversal axis relative to said shaft from a substantially horizontal position to a vertical position, said pivoting member adapted to hook onto the sleeve member of the spinning top, whereby said riding rim is adapted to frictionally engaged said post when said pivoting member is in the horizontal position.

2. A driving and control device as recited in claim 1, wherein said riding rim comprises a platform concentrically secured to said tubular member, the said platform being provided with a circular lip extending above the platform on the side opposite the tubular member.

3. A driving and control device as recited in claim 2, wherein the said shaft projects outside said tubular member at the end opposite the riding rim.

4. A driving and control device as recited in claim 3, wherein said pivoting member has an internally threaded housing adapted to retain said sleeve member.

5. In combination, a spinning top and driving and control device as recited in claim 4 , said spinning top comprising a post, a flywheel having a weighted portion concentrically disposed around said post, a friction ring tightly surrounding said post for frictionnally engaging said riding rim and for causing said top to spin upon giration of the post around said shaft, and a rotatable sleeve member axially mounted at one end on said post for rotatably connecting said pivoting member.

6. A spinning top and a driving and control device as recited in claim 5, wherein said flywheel comprises a disc-like member and circular rib surrounding said disc member.

7. A spinning top and a driving and control device as recited in claim 5, comprising bearing means for rotatably connecting said post to said sleeve member.

8. A spinning top and a driving and control device as recited in claim 7, wherein said bearing means comprises a pair of adjacent ball-bearing rings mounted between said post and said sleeve member, at least one of said ball-bearing rings being partially recessed in both the post and the sleeve member.

9. A spinning top and a driving and control device as recited in claim 6, wherein said flywheel and said post are rotatably mounted in a casing adapted to be connected to said pivoting means, the said casing being provided with two diametrically opposite apertures adapted to allow the riding rim to frictionnally engage the post for allowing the rotation of the post and the flywheel inside the casing.

10. A spinning top and a driving and control device as recited in claim 6, wherein said post has a tip extending from said disc-like member in the direction opposite said sleeve.

11. A driving and control device as recited in claim 1, comprising two pivoting members hingely secured to said one end of said shaft adjacent said riding rim, said pivoting members being hingely connected to said shaft so as to be orientable in opposite direction.

12. A spinning top and a driving and control device as recited in claim 10, comprising a second spinning top hingely mounted to said top and rotatably mounted on said first mentioned top, the said second top having a flywheel with a rib-like member adapted to rotatably abut against the first mentioned rib-like member.

13. A spinning top and a driving and control device as recited in claim 5, wherein the said end of the shaft opposite the riding rim has a recess adapted to fittingly receive the free end of the said sleeve member.

* * * * *